United States Patent [19]

Kuenzel

[11] Patent Number: 4,648,510

[45] Date of Patent: Mar. 10, 1987

[54] EASILY DISPENSABLE DETERGENCY BOOSTER CLOTHS AND DISPENSER THEREFOR

[75] Inventor: Werner Kuenzel, Langenfeld, Fed. Rep. of Germany

[73] Assignee: Henkel Kommanditgesellschaft auf Aktien, Duesseldorf, Fed. Rep. of Germany

[21] Appl. No.: 818,570

[22] Filed: Jan. 13, 1986

[30] Foreign Application Priority Data

Jan. 14, 1985 [DE] Fed. Rep. of Germany ..... 3500936

[51] Int. Cl.[4] ..... B65D 79/00; B65D 83/08; B65D 85/62; C11D 17/06

[52] U.S. Cl. ..... 206/494; 206/233; 206/449; 221/33; 221/47; 252/90; 252/91; 428/43; 428/119; 428/131; 428/134

[58] Field of Search ..... 206/233, 449, 494, 499, 206/555; 221/33, 47, 50, 63; 252/90, 91; 427/242; 428/43, 119, 131, 134; 312/50

[56] References Cited

U.S. PATENT DOCUMENTS

| | | | |
|---|---|---|---|
| Re. 31,885 | 5/1985 | Meitner | 252/91 |
| 2,648,635 | 8/1953 | Brown | 252/91 |
| 2,923,435 | 2/1960 | Chaplin | 206/494 |
| 3,243,079 | 3/1966 | Rettmer | 221/63 |
| 3,265,241 | 8/1966 | McColgan | 221/47 |
| 3,674,286 | 7/1972 | Dodgson | 428/43 |
| 3,816,321 | 6/1974 | Kleinschmidt | 252/134 |
| 3,944,694 | 3/1976 | McQueary | 428/131 |
| 3,954,642 | 5/1976 | Schwuger | 252/91 |
| 3,955,920 | 5/1976 | Krauch | 8/137 |
| 3,956,155 | 5/1976 | Schwuger | 252/91 |
| 4,170,565 | 10/1979 | Flesher | 252/93 |
| 4,397,754 | 8/1983 | Collishaw | 252/91 |
| 4,448,704 | 5/1984 | Barby | 252/91 |
| 4,487,318 | 12/1984 | Roen | 206/554 |
| 4,515,703 | 5/1985 | Haq | 252/92 |
| 4,524,095 | 6/1985 | Gockel | 428/43 |
| 4,532,063 | 7/1985 | Gueldenzopf | 252/90 |
| 4,587,146 | 5/1986 | Anhauser | 428/41 |

FOREIGN PATENT DOCUMENTS

| | | | |
|---|---|---|---|
| 0013450 | 7/1980 | European Pat. Off. | 252/91 |
| 562558 | 11/1923 | France | 206/57 R |

*Primary Examiner*—Dennis L. Albrecht

*Attorney, Agent, or Firm*—Ernest G. Szoke; Henry E. Millson, Jr.; Mark A. Greenfield

[57] ABSTRACT

In order to facilitate lifting a booster cloth containing a detergency booster and which dissolves in water during washing from a stack arranged in a dispenser without any special aids, a curved incision is made at the center of gravity of the cloth and the stack of cloths is mounted in an upwardly convex arcuate fashion in such a way that a tab area projects upward from the surface of the cloth along the incision.

10 Claims, 6 Drawing Figures

EASILY DISPENSABLE DETERGENCY BOOSTER CLOTHS AND DISPENSER THEREFOR

BACKGROUND OF THE INVENTION

1. Field of the Invention

This invention relates to a booster cloth comprising a sheet of material which dissolves in water during laundering and which contains releasable active detergency boosters. The invention also relates to a dispenser for the booster cloths and to a method of making this dispenser.

2. Description of Related Art

Detergency boosters are added to heavily soiled and/or stained laundry to provide peak performance of conventional detergents, particularly at low laundering temperatures. While conventional detergents are often introduced via the dispensing compartment of the washing machine, detergency boosters are placed directly in the washing machine before or after it is loaded with dirty laundry.

One commercially available type of detergency booster is the booster cloth (also called booster film or booster sheet). This product takes the form of a solid sheet of material into which all the active ingredients of the particular detergency booster are already incorporated. The cloths are designed to dissolve completely in the wash water under laundering conditions. In order to provide the requisite water solubility, these booster cloths are formulated from materials, typically polyvinyl alcohols, which make the resulting cloth extremely brittle with only minimal tear resistance. Because of these poor structural properties, this type of booster cloth cannot be bent through 180°, i.e., folded, without breaking. It is also difficult to wind them into rolls (on tubes) because, under tensile stress, the material tends to tear randomly rather than along a predetermined perforation line. Accordingly, there would be no guarantee of proper dosage. In practice, therefore, the individual cloths are stored stackwise and have to be individually lifted off upwards for use.

DESCRIPTION OF THE INVENTION

It is an object of the present invention to provide a booster cloth that is adapted for easy removal from a dispensing container in which a plurality of the cloths are disposed in a stacked relationship.

Another object of the present invention is to provide a booster cloth that can be removed from such a container without any special aids and without risk of damage or tearing of the cloth.

It is also an object of the present invention to provide a booster cloth dispenser, from which booster cloth can be readily removed by hand without risk of damage or tearing of the cloth.

In accordance with these, and other objects which will be apparent to those skilled in the art, the present invention provides a booster cloth adapted for easy removal from a dispensing container in which a plurality of said cloths are disposed in a stacked arrangement, the booster cloth comprising a sheet of a material which dissolves in water under laundering conditions and which contains releaseable active detergency boosters, this sheet containing a curved incision therethrough to facilitate grasping the sheet when the sheet is disposed in the container in such a manner that the sheet is in flexure in the area containing the incision.

The present invention also relates to a booster cloth dispenser containing a stack of the described booster cloths disposed in an upwardly convex arcuate fashion causing flexure in the area of the curved incision. This can be accomplished by sizing the dispenser so that the cloths only fit in such a fashion, or by disposing the stack of sheets on a pre-formed base structure having a configuration that holds the stack in this fashion.

The present invention further provides a method for making the above-described dispenser.

Figure 1:
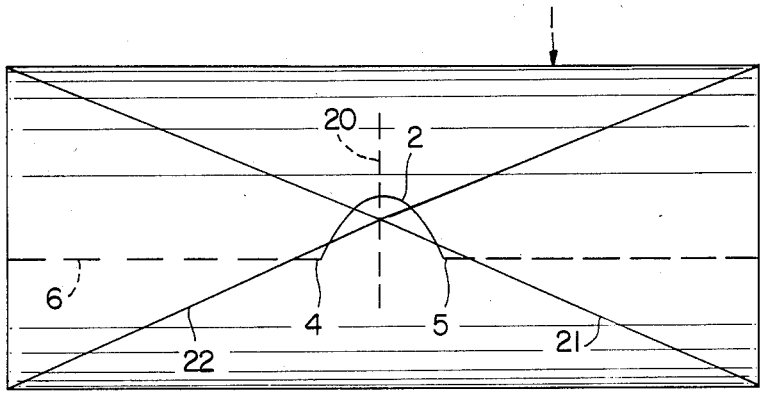
FIG. 1 is a plan view of a rectangular booster cloth with a tab-forming curved incision.

The booster cloth of the present invention shown in its preferred configuration in FIG. 1 generally comprises a sheet of material which dissolves in water under laundering conditions and which contains releaseable active detergency boosters which are released into the wash water upon dissolution of the booster cloth sheet. The booster cloth itself can be made from any suitable water soluble material that can be formed into a sheet having sufficient structural integrity to permit its handling in the preparation, packaging and use of the booster cloth. Such materials and the methods of manufacturing sheets therefrom are well known in the art. Among the suitable materials for forming this base sheet are water soluble polymeric materials such as polyvinyl alcohols. The detergency boosters that are incorporated into the water soluble base sheet may comprise any of the well known materials which serve to augment or enhance the activity of laundry detergents. As used throughout this specification, "boosters" include both known detergent builders and known detergent additives. These detergency booster materials can be incorporated into the water soluble base sheet by any suitable method including providing the additives with the base sheet materials prior to the formation of the sheet or by coating or impregnating the preformed sheet with these additive materials.

As shown in the preferred embodiment of FIG. 1, the booster sheet is preferably of rectangular shape, although other shapes may be employed. While the size and thickness of the booster cloth are generally dictated by practical considerations, any suitable size and shape of material can be employed in the practice of the present invention. In order to provide the proper dosage level of detergency boosters in the washing machine, it is only necessary to control the concentration of detergency boosters in the booster cloth. In this fashion, an appropriately measured dose of detergency booster can be uniformly applied to various size booster sheets depending on esthetic of functional considerations. For typical laundry applications, the size of the booster cloth should be one which can be conveniently used and is adapted to being dispensed from a container. In a preferred embodiment of the present invention, a booster cloth of this configuration may be optimally sized at about 140 mm wide and 240 mm long. The thickness of the booster cloth may vary with the water solubility characteristics of the base material, the dosage level of detergency boosters, and general esthetic considerations. Typically, booster cloth thicknesses in the range of about 0.5 to 4 mm may be employed.

An important aspect of the present invention is the provision of a curved incision through the booster cloth which incision serves to define a tab area, or in the alternative embodiment, an aperture through the booster cloth sheet in such a fashion that removal of a booster cloth sheet from a stack of sheets in a dispenser is facilitated. In a preferred embodiment shown in FIG. 1, the curved incision 2 is generally symmetrical about axis 20 and has ends 4 and 5. The shape of this preferred curve is generally elliptical with the axis 20 being parallel to the ends of the booster cloth and perpendicular to the sides of the booster cloth. In the preferred embodiment, line 6, which passes through the ends 4 and 5 is parallel to the sides of the booster cloth and perpendicular to axis 20 of the incision.

Other suitable forms of the curved incision 2 are shown in FIGS. 2(I), (II), (III), (IV) and (V). These shapes are merely illustrative as any curved line which forms a tab area or an aperture can be employed. Where the curved incision is complete, i.e., an aperture is formed through the booster cloth, the shape of the incision may be circular as shown in FIG. 2(V), or may be of any other suitable shape such as elliptical or oval.

Figure 2:
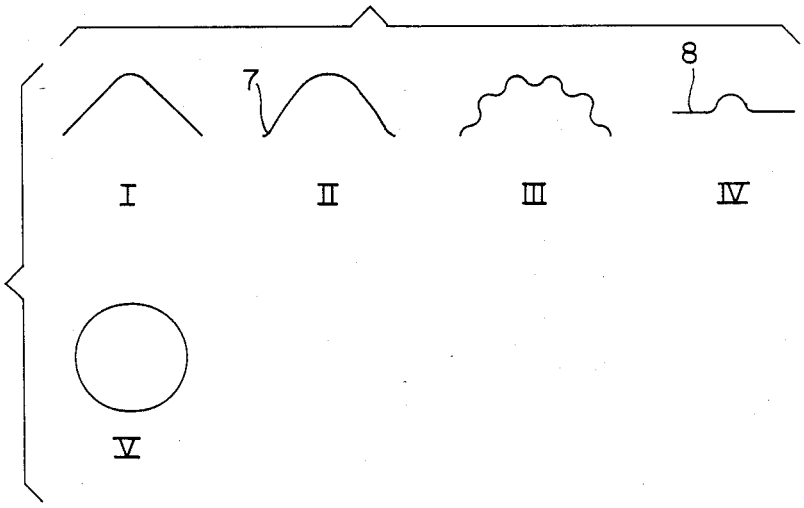
FIG. 2 shows a number of alternative incision forms.

As shown in FIG. 2(II), the end portions 4 and 5 of curved incision 2 may be provided with counter-curves 7, i.e., the radius of curvature changes from that of the general shape of the incision to provide terminal portions which reduce the tendency of the booster cloth sheet to tear at the incision ends. Similarly, as shown in FIG. 2(IV), the curved incision 2 may be provided with flat line extensions 8.

The preferred location of the curved incision is at or near the center of gravity of the booster cloth sheet. This location can be approximated by locating the axis 20 of curved incision 2 at the point where the diagonals 21 and 22 of the booster sheet intersect. In this embodiment, for example, line 6, which passes through ends 4 and 5 of incision 2 is parallel to the sides of the booster sheet but offset from the parallel line that would pass through the intersection of diagonals 21 and 22. By this construction, the grasping and lifting point on the tab area defined by curve incision 2 falls generally near the center of gravity, i.e., at the intersection of the diagonals.

The length of incision 2 or corresponding diameter of an aperture incision such as that shown in FIG. 2(V) is not critical and need only be sized relative to the overall dimensions of the booster cloth sheet, keeping in mind that the function of this tab area or aperture is to provide manual lifting. Accordingly, the size of the tab or area of the aperture should correspond roughly to a dimension which is easily grasped by the human hand. The aperture is formed in the booster sheet in any suitable fashion such as cutting or punching. In the case of a curved incision of the type shown in FIGS. 1 or 2, cutting with a suitable knife or the like is preferred whereas the formation of an aperture such as that shown in FIG. 2(V) is more easily formed by punching.

As mentioned above, the function of the incision is to provide a tab area or aperture which facilitates the upward removal of the top booster cloth sheet from a stack of booster cloths contained in a product dispenser. In order for this tab or aperture area to provide that function, it is necessary to subject the booster cloth sheets in the container to a condition of flexure whereby the tab area or area surrounding the aperture projects outwardly and upwardly from the surface of the booster cloth when it is positioned in this fashion.

Figure 3:
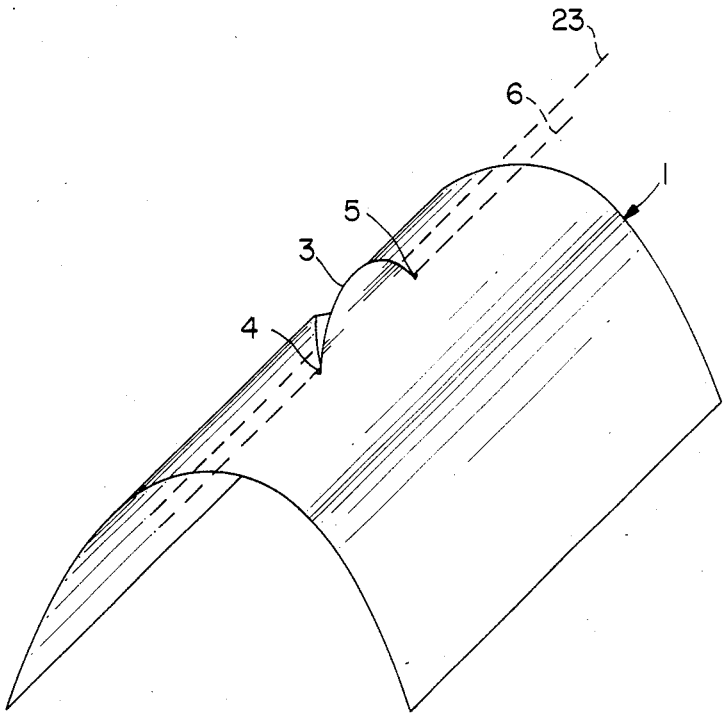
FIG. 3 is a pespective view of a booster cloth in upwardly convex arcuate fashion with a grip tab which springs up automatically.

FIG. 3 illustrates this function. In FIG. 3, the booster sheet 1 is flexed to give it an upwardly convex arcuate, or saddle-like configuration. As seen in FIG. 3, the tab 3 defined by ends 4 and 5 of the curved incision pops up when the area surrounding this tab is put in flexure. In a preferred configuration, the axis 23 of the arcuate sheet, (i.e., a line tangent to the surface at its upwardmost point and parallel to the sides) is parallel to and just offset from line 6 which passes through ends 4 and 5 of the incision. Axis 23 preferably passes through the point of intersection of diagonals 21 and 22 shown in FIG. 1. When the curved incision is in the form of an aperture, the edges of the aperture are slightly flexed in the same fashion to provide means for gripping and lifting booster sheets off a stack of arcuately flexed sheets.

By employing this configuration, the tab area is preferentially situated in the region of maximal flexure, thereby increasing the projection in tangent fashion of the tab area away from the radius of curvature of the arcuately flexed sheet. By locating the incision, and therefore the lifting tab, at the center of gravity of the booster cloth sheet, the danger of tearing can be minimized by virtue of uniform distribution of the weight.

Figure 4:
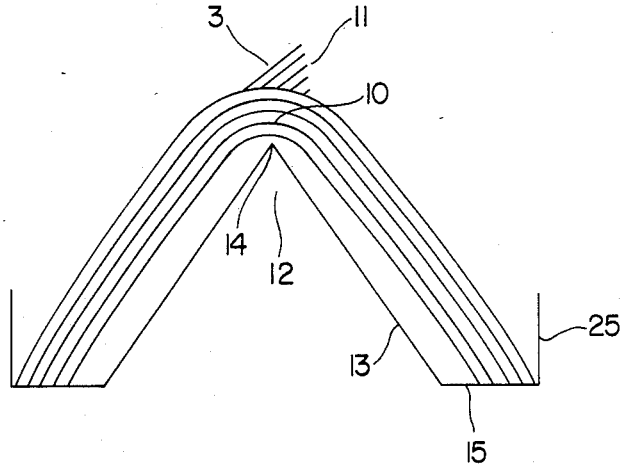
FIG. 4 is a sectional view through a stack of booster cloths, maintained in upwardly convex arcuate fashion by a base member having an angular apex.
Figure 6:
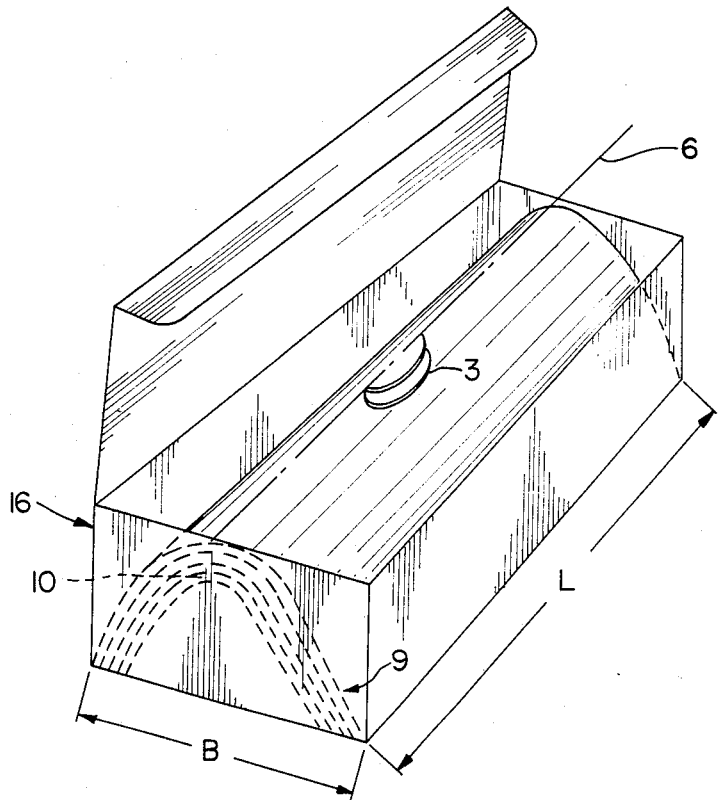
FIG. 6 is a perspective view of a filled booster cloth dispenser.

In providing a dispenser for the booster cloths of the present invention, a plurality of the sheets shown in FIG. 3 are stacked in parallel configuration in a container maintaining the arcuately flexed configuration of the sheet, as shown in FIG. 6. As best seen in FIG. 4, the tab projections 3 of each lower successive sheet protrude through the space in the sheet immediately above to form tab assembly 11.

Container 16 shown in FIG. 6 is preferably in the form of a rectangular box although any other suitable configuration may be employed which is adapted to maintain the stack of arcuately flexed booster sheets in that configuration during storage and use. This objective may be accomplished in two basic ways. First, as shown in FIG. 6, the dimensions of the container or box 16 may be chosen such that its width B is narrower than the transverse dimension of the corresponding booster sheets in stack arrangement 9, thereby producing the flexed arcuate configuration. In this embodiment, the length L of the container typically is equal to or greater than the length of the booster cloth sheets.

Figure 5:
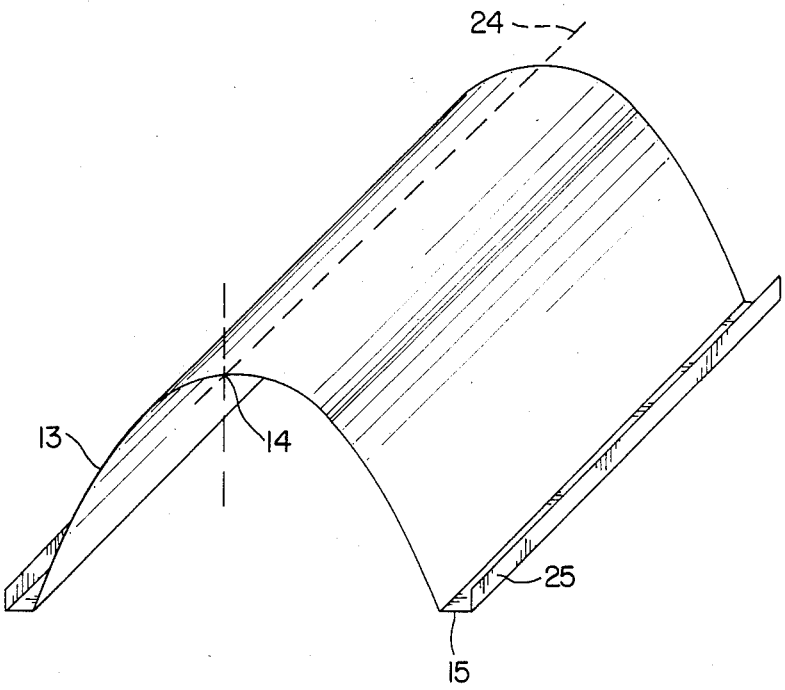
FIG. 5 is a perspective view of an alternative base member having a rounded apex.

In alternative embodiment, the flexed arcuate configuration of the booster cloth sheet stack is maintained by providing a base member which may be removable from the container or integrally formed therein. This base member, which is element 13 in FIGS. 4 and 5, is provided with an apex 14 which may be rounded as shown in FIG. 5 or angular as shown in FIG. 4. In the preferred embodiment, axis 24 of the base member (see FIG. 5), will be directly under axes 23 of the booster cloth sheets in the stack. Where the booster cloths are of an extremely brittle formulation, it has been found advantageous to employ the round apex shaped base member shown in FIG. 5 rather than the angular apex shaped base member of FIG. 4.

Also as shown in FIGS. 4 and 5, the base member 13 is preferably provided with flanking portions which serve to retain the stack ends against lateral motion. This is preferably accomplished by a flat portion 15 extending from the base member ends followed by an upstanding or perpendicular portion 25 which serves to support the sheet ends in a non-movable fashion.

In the process for making the preferred booster cloth dispenser, the base member 13 can be separately provided as a cardboard blank as shown in FIGS. 4 and 5 and may serve as a guide or pushing aid for assembling the dispenser to facilitate lateral filling of the container. Booster cloth stack 9 which is introduced into container 16 in this fashion remains arched upwardly and this stack will not slip even during transportation and use of the dispenser. When using this base member, the transverse dimension of the container may be selected large enough to provide easy introduction of stack into the container while at the same time permitting individual booster cloths to be readily removed from the dispenser by hand.

Various alternative embodiments are possible within the scope of this invention. For example, the tab 3 may have an angle-cut edge so as to define a V or rectangle. This is a less preferred embodiment, because a sharply pointed tab may tend not to separate from the cloth and project upward to form tab assembly 11. The base member 13 may be formed integrally with the container 16 by suitable folding of the container bottom (when cardboard) of by suitable molding or thermal deformation of the bottom (when plastic). Because of the nature of the booster cloths and the impregnated active substances, it is preferred that the cloths not be folded.

I claim:

1. A detergency booster cloth dispenser assembly containing an aligned stack of easily removable booster cloths, each said booster cloth comprising a sheet of material which dissolves in water under laundering conditions and which contains releaseable active detergency boosters, each said booster cloth being provided with a curved incision approximately through its center and said dispenser being adapted to maintain each sheet of said stack in an upwardly convex arcuate fashion in said dispenser so as to place said sheets in flexure in the area of said incision.

2. The assembly of claim 1 wherein said sheets are maintained in said upwardly convex arcuate fashion by providing said dispenser with a transverse dimension smaller than that of said sheet in the same direction.

3. The assembly of claim 1 wherein said stack is maintained in said upwardly convex arcuate fashion by a base member upon which said stack is disposed, said base member comprising an upwardly convex arcuate surface having an axis substantially parallel to a line through the ends of said incision.

4. The assembly of claim 2 wherein said base includes flanking portions on the transverse sides of said base, said flanking portions being adapted to retain the ends of said sheets against lateral movement.

5. The assembly of claim 3 wherein said base member is formed separately from said containers.

6. The assembly of claim 3 wherein said base member is integral with said container.

7. The assembly of claim 1 wherein said curved incision defines a tab area which protrudes from said sheet when said sheet is held in flexure.

8. The assembly of claim 1 wherein said curved incision defines an aperture.

9. The assembly of claim 3 wherein said curved incision defines a tab area which protrudes from said sheet when said sheet is held in flexure.

10. A method for making a detergency booster cloth dispenser containing a stack of easily removable booster cloths, each said booster cloth comprising a sheet of material which dissolves in water under laundering conditions and which contains releaseable active detergency boosters, said method comprising the steps of:

(a) making a curved incision through the same location in each sheet to form a tab area or aperature in said sheet;

(b) disposing a plurality of the incised sheets in a stacked relationship in a container which is adapted to hold each of said sheets in said stack in an upwardly convex arcuate fashion so as to place said sheets in flexure in the area of said incision, the axis of the arcuately flexed sheet (i) being parallel to a line connecting the ends of the tab-forming curved incision or (ii) passing through or close to the aperture-forming curved incision; the tab areas or apertures in the stack being aligned.

* * * * *